US007401774B2

(12) United States Patent
Ginzton

(10) Patent No.: US 7,401,774 B2
(45) Date of Patent: Jul. 22, 2008

(54) DUAL FRICTION REGION SEPARATION PAD, AND MEDIA SEPARATOR AND MEDIA SEPARATOR MECHANISM USING SAME

(75) Inventor: Nathaniel D. Ginzton, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 550 days.

(21) Appl. No.: 11/128,241

(22) Filed: May 13, 2005

(65) Prior Publication Data

US 2006/0255526 A1 Nov. 16, 2006

(51) Int. Cl.
*B65H 3/52* (2006.01)

(52) U.S. Cl. ..... 271/124; 271/121; 271/122

(58) Field of Classification Search ..... 271/121–125, 271/104, 137, 167
See application file for complete search history.

(56) References Cited

U.S. PATENT DOCUMENTS

| | | | | | |
|---|---|---|---|---|---|
| 3,768,803 | A | | 10/1973 | Stange | |
| 3,958,800 | A | * | 5/1976 | Gates | 271/126 |
| 4,397,542 | A | * | 8/1983 | Brodesser | 347/139 |
| 5,163,668 | A | * | 11/1992 | Winship et al. | 271/121 |
| 5,374,047 | A | | 12/1994 | Tsukamoto et al. | |
| 5,435,538 | A | | 7/1995 | Billings et al. | |
| 5,584,475 | A | * | 12/1996 | Asada et al. | 271/121 |
| 5,727,782 | A | * | 3/1998 | Okada | 271/121 |
| 6,880,822 | B2 | * | 4/2005 | Fukushima et al. | 271/157 |
| 7,128,316 | B2 | * | 10/2006 | Nakano et al. | 271/121 |
| 2002/0096819 | A1 | * | 7/2002 | Fukasawa et al. | 271/121 |
| 2004/0012140 | A1 | * | 1/2004 | Asada et al. | 271/121 |
| 2004/0017039 | A1 | * | 1/2004 | Asada et al. | 271/121 |

FOREIGN PATENT DOCUMENTS

| | | |
|---|---|---|
| JP | A 06-009089 | 1/1994 |
| JP | A 11-349167 | 12/1999 |

OTHER PUBLICATIONS

"Standard Test Method for Static and Kinetic Coefficients of Friction of Plastic Film and Sheeting"; American Society of Testing Materials; Designation: D 1894-87; pp. 128-132.

* cited by examiner

*Primary Examiner*—Patrick Mackey
*Assistant Examiner*—Thomas A Morrison
(74) *Attorney, Agent, or Firm*—Oliff & Berridge, PLC

(57) ABSTRACT

A media separator, that cooperates with a media pick to form a nip in a feed path of a media handling apparatus, supports a separation pad that includes first and second friction regions for movement relative to the media separator, against a bias force, in a feed direction of a sheet of media through the nip. The first and second friction regions selectively engage the sheet of media passing through the nip with a retard/separation force determined by the bias force, to retard and control a feeding operation of the sheet of media through the nip, and to feed plural sheets of media through the nip one at a time.

15 Claims, 5 Drawing Sheets

FIG. 1
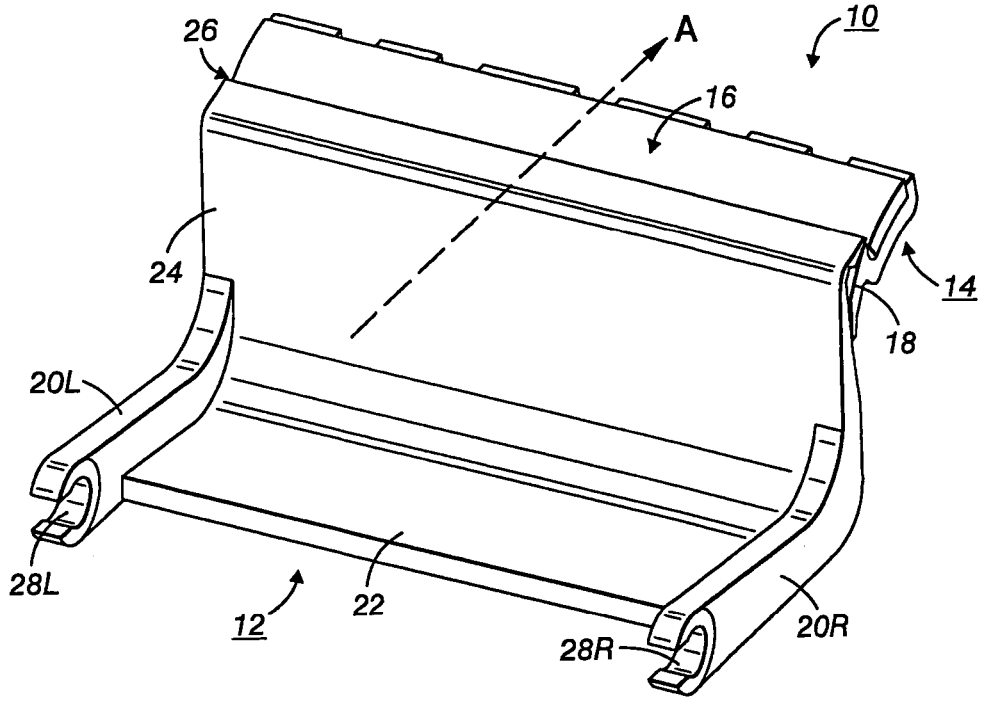
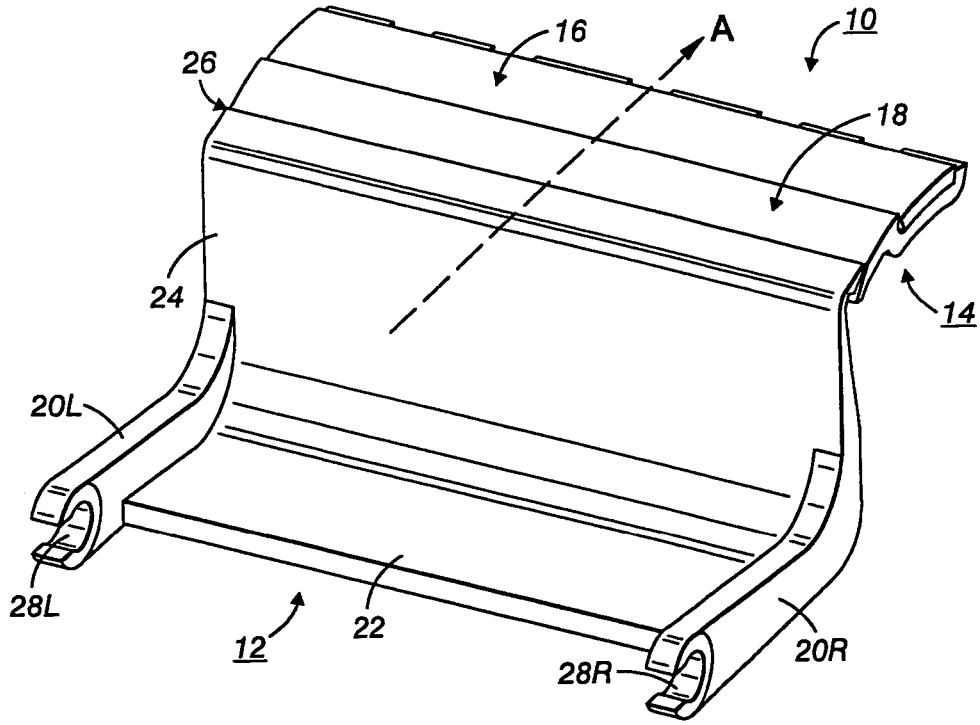
FIG. 2

FIG. 7
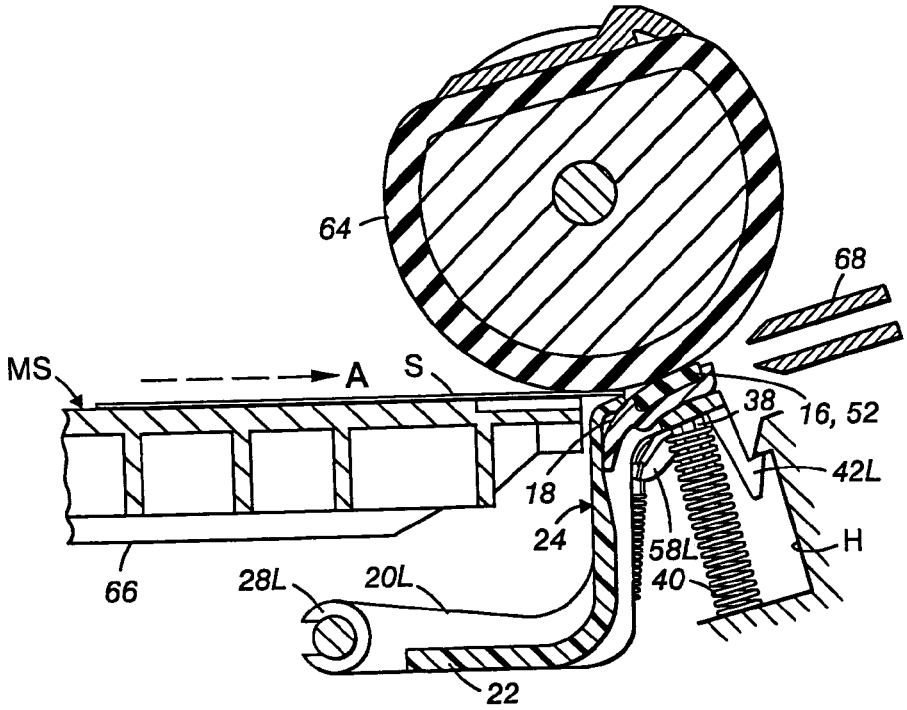
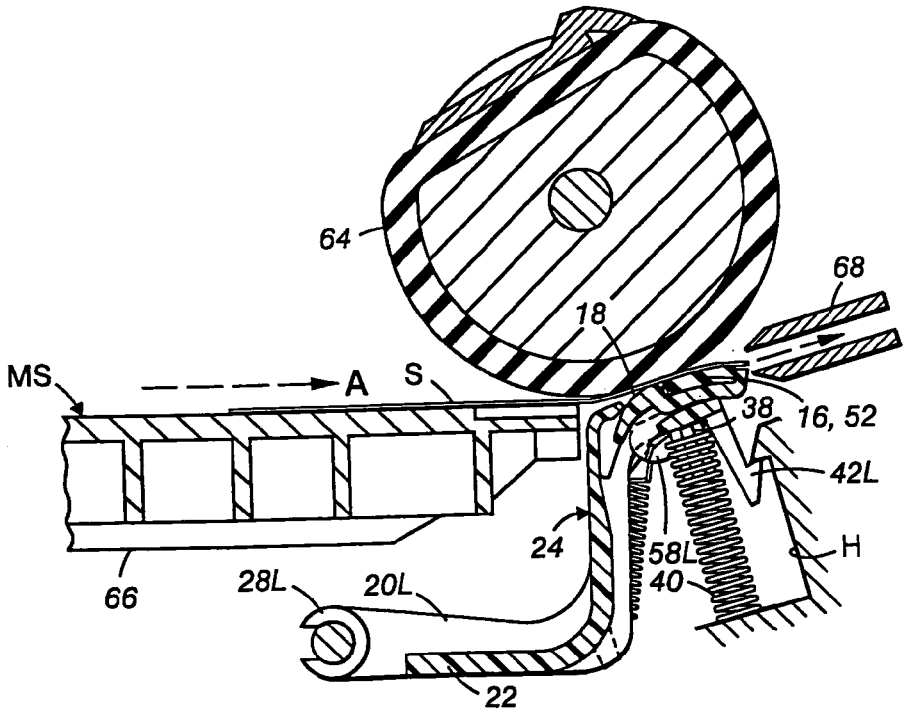
FIG. 8

DUAL FRICTION REGION SEPARATION PAD, AND MEDIA SEPARATOR AND MEDIA SEPARATOR MECHANISM USING SAME

BACKGROUND

The present disclosure relates generally to a separation pad and media separator used for handling sheets of media. More particularly, the present disclosure relates to a separation pad that includes first and second friction regions, and a media separator that supports the separation pad for movement relative to the media separator in a sheet feeding direction through a nip formed by the media separator. The first and second friction regions selectively engage a sheet of media fed through the nip, with a retard/separation force determined by the bias force, to retard and control a feeding operation of the sheet of media fed through the nip, and to feed plural sheets of media through the nip one sheet at a time. The present disclosure further relates to a media separator mechanism including a media pick and the separation pad and media separator.

A separation pad, media separator and media separator mechanism of the present disclosure have particular utility in a media handling system that handles a plurality of types of media. However, the separation pad, media separator and media separator mechanism of the present disclosure may have utility in any apparatus that handles sheets of media.

Media handling systems are known. Examples include readers, scanners, printers, copiers, facsimile machines and the like. Such media handling systems handle a variety of media having a variety of different physical characteristics. Examples of paper media include lightweight stock, standard stock, bond, cardstock, glossy, envelopes and the like. Examples of other media include transparencies, films, labels and the like. These media have various physical characteristics or properties, including strength, thickness, surface coefficients of friction and the like, that can vary over a wide range. System designers must design media handling systems to accommodate these variations in physical characteristics.

Media separators are known. Generally, a media separator cooperates with a media pick to form a nip in a feed path of a media handling apparatus to control a feed operation of a sheet of media through the nip. For example, a media separator and media pick may form a media pick and separation mechanism, for picking up and feeding a plurality of sheets of media from a media stack on a media tray, one sheet at a time. As used herein, a media pick generally is a device that frictionally engages a top surface of a sheet of media and provides a frictional force for driving the sheet of media into and through a nip in a feed path. As used herein, a media separator generally is a structure or device that frictionally engages a bottom surface of a sheet of media fed through the nip. During a feeding operation, the media separator applies a retard/separation force to a sheet of media in contact with the media pick sufficient to control the feeding operation of the sheet of media through the nip; the media separator applies a retard/separation force to a sheet of media other than a sheet of media in contact with the media pick sufficient to separate plural sheets of media simultaneously fed into the nip, to feed the plural sheets of media one at a time.

Conventional media separators generally come in one of two forms. In one form, the media separator includes a fixed contact surface including a friction surface or separation pad that opposes the media pick. The contact surface frictionally engages each sheet of media in the nip to retard and control a feeding operation of the sheet of media fed through the nip. In a second form, the media separator includes a retard roller having a rotation surface or tire that opposes the media pick. The retard roller rotates through the nip against a reverse-bias torque to retard and control a feeding operation of the sheet of media fed through the nip. The retard roller can be undriven (passive) or driven in a reverse direction relative to the media pick (active).

Design criteria of a simplified media pick and separation system are described here by way of example. To advance a top sheet of media through a nip, the media pick must generate a drive force $F_{drive}$ greater than the retard/separation force $F_{ret/sep}$ of the media separator. To prevent simultaneous feeding of multiple sheets through the nip, the media separator must generate a retard/separation force $F_{ret/sep}$ on a bottom sheet of media greater than the potential friction force between the individual sheets of media $F_{sheet\text{-}sheet}$. Thus, the following relationship must be satisfied:

$$F_{drive}>F_{ret/sep}>F_{sheet\text{-}sheet} \quad (1)$$

The drive force $F_{drive}$ depends directly on the nip force $F_{nip}$ and the coefficient of friction of the media pick on the sheet of media $\mu_{pick\text{-}media}$, as follows:

$$F_{drive}=F_{nip}\times\mu\text{pick-media} \quad (2)$$

Materials suitable for use as a media pick limit the available drive force. These materials typically include ethylene propylene diene monomer (EPDM), urethane, latex and like elastomers. Common values for the coefficient of friction of media picks are around 2.0. However, contamination and wear can lower this value to 1.5 or less. In this regard, values for coefficients of friction ($\mu$) used in this application refer to values determined according to the American Society of Testing and Materials (ASTM) standard methods. Those skilled in the art will recognize that coefficients of friction may vary depending on the conditions and method of detection.

The sheet-to-sheet frictional force $F_{sheet\text{-}sheet}$ depends on the nip force $F_{nip}$ and the coefficient of friction between the sheets of media $\mu_{sheet\text{-}sheet}$, as follows:

$$F_{sheet\text{-}sheet}=F_{nip}\times\mu_{sheet\text{-}sheet} \quad (3)$$

A system designer has substantially no control over the sheet-to-sheet frictional force. The system user selects the media for each application. The coefficient of friction for standard office media is about 0.5. However, media coatings, static charge buildup, and other factors can effectively raise this value to 1.0 or higher.

A system designer must design the media separator to generate a retard/separation force that fits within the window between these two limits—the drive force and the sheet-to-sheet frictional force—to reliably separate plural sheets of media simultaneously fed into the nip. If the retard/separation force is too close to the frictional drive force, then media pick errors/failures will occur. If the retard/separation force is too close to the sheet-to-sheet friction force, then multiple sheet pick errors will occur. Also, the optimal relationship of drive force to retard/separation force is different for each media, and often the overlap between acceptable settings is small.

A separation pad is an inexpensive and compact media separator. Conventional separation pads-generally use a stationary friction surface to form a nip with a media pick. In such a mechanism, the retard/separation force $F_{ret/sep}$ is directly related to the nip force $F_{nip}$ and the coefficient of friction of the separation pad with the media $\mu_{pad\text{-}media}$, as follows:

$$F_{ret/sep}=F_{nip}\times\mu_{pad\text{-}media} \quad (4)$$

In a separation pad mechanism, the nip force thus directly affects each of the drive force, the retard/separation force and the sheet-to-sheet force.

Accordingly, although a separation pad mechanism has utility in many applications, it has a drawback in that the only independent variable affecting the separation force that a system designer can manipulate is the coefficient of friction of the separation pad. That is, this mechanism provides a narrow window of acceptable coefficients of friction. A system designer may have difficulty finding a material for the separator pad that meets the system design criteria. In addition, system wear and contamination can change the coefficient of friction of a material over time, causing a decrease in system performance or system failure.

A retard roller is a more reliable media separator. A retard roller generally is a roller that cooperates with the media pick to form the nip, and resists turning relative to the media pick/sheet of media by some known amount of torque $T_{retard}$. This mechanism thus provides a designer with an additional variable to adjust the retard/separation force. Specifically, the retard/separation force $F_{ret/sep}$ in this mechanism is the lesser of:

$$F_{ret/sep}=T_{retard}/r_{roller} \quad (5)$$

and $$F_{ret/sep}F_{nip}\times\mu_{roller\text{-}media} \quad (6)$$

where $r_{roller}$ is the radius of the retard roller, and where $\mu_{roller\text{-}media}$ is the coefficient of friction between the retard roller and the sheet of media.

A system designer thus may choose to use a retard roller material having a coefficient of friction sufficiently high to make the first equation applicable. This makes the retard/separation force $F_{ret/sep}$ independent of the nip force, which permits the system designer to independently manipulate the media pick drive force and retard/separation force.

Although retard roller mechanisms have utility in many applications, they have a drawback in that they require additional elements, such as drive motors, controllers, clutch mechanisms and the like, which require additional space, technical maintenance and cost.

Various media separator mechanisms using separation pads and retard rollers are known. The following three examples illustrate media separator mechanisms using various media picks and separation pads or retard rollers.

U.S. Pat. No. 3,768,803 discloses a sheet feeder including a media pick and separation pad for separating sheets of media to be fed one at a time through a nip formed between the media pick and the separation pad. The media pick includes an endless sheet separation belt driven around plural rollers. One roller, the pick roller, is provided adjacent an edge of a stack of sheets of media (media stack) so that the sheet separation belt is in press contact with a top surface of the top sheet of media in the media stack at a region of edge contact. The separation pad includes a jaw and tongue member that opposes the pick roller and sheet separation belt to form a mouth of the nip, and a frictional surface that opposes the sheet separation belt in a region between the pick roller and another roller to form a queuing throat of the nip.

The sheets of media are fed by frictional driving force. The separation belt by frictional force pulls the top sheet of media into the mouth of the nip; the top sheet engages the jaw and tongue member of the separator pad and is guided into the throat of the nip, where the top sheet of media engages the frictional surface of the separator pad with a frictional force that retards movement of the top sheet through the throat of the nip. The top sheet of media by frictional force in turn pulls the next adjacent sheet of media (second sheet) into the mouth of the nip; the second sheet engages the jaw and tongue member and is guided into the throat of the nip, where the second sheet engages the frictional surface of the separator pad with a frictional force that retards movement of the second sheet into the throat of the nip. Each sheet of media exerts a similar (although gradually smaller) frictional force and pull on a successive sheet of media in the media stack. In this manner, the separation belt pulls plural sheets of media into the mouth and queuing throat of the nip, and into frictional engagement with the frictional surface of the separator pad, and the plural sheets of media in the queuing throat engage the frictional surface of the separation pad in a stepped or staggered manner.

A desired one-at-a-time sheet feeding operation is obtained by selecting materials having suitable coefficients of friction and selecting suitable contact pressure forces. The frictional (driving) force between the separation belt and the top sheet of media is determined by the coefficient of friction of the separation belt, the coefficient of friction of the sheet of media, and the contact pressure between the media pick roller/separation belt and the media stack. The frictional (driving) force between adjacent sheets of media is determined by the coefficient of friction of each sheet of media and the contact pressure of the media pick roller/separation belt on the media stack. The retard force for each sheet is determined by (1) a frictional force between each sheet and its successive sheet of media in the stack, which is determined by the coefficient of friction of the sheets of media and the contact pressure of the media pick roller on the media stack, and (2) the frictional (retard) force between the frictional surface of the separation pad and each sheet of media in the queuing throat of the nip, which is determined by the coefficient of friction of the frictional surface of the separation pad, the coefficient of friction of each sheet of media, and a pressure force of the separation belt in a direction normal to the separation pad surface; in practice, the retard/separation force for each sheet of media in the queuing throat of the nip is substantially the same. Accordingly, for sheets of media having a given coefficient of friction, a system designer can design the media separation mechanism to feed plural sheets of media, one at a time through the nip, by selecting a separation belt having a suitable coefficient of friction (relatively large), a frictional surface of the separation pad having a suitable coefficient of friction (relatively large), a suitable contact pressure for the media pick roller/separation belt on the media stack, and a suitable pressure force of the separation belt normal to the separation pad surface.

Although this media separator mechanism (and method) has utility in many applications, it suffers a general drawback of separation pad mechanisms, in that the retard/separation force is directly dependent on the nip force and coefficient of friction of the separator pad. Since both the drive force and separation force are dependent on the nip force, the coefficient of friction of the separator pad is the only independent variable. There are many different types of media having different coefficients of friction, and finding a separator pad material that meets the coefficient of friction requirement along with all of the other physical requirements is difficult.

Media separator mechanisms using media separators having plural friction regions are known. U.S. Pat. No. 5,374,047 discloses a sheet feeder including a media pick and a media separator having a separation pad. The media pick is a single pick roller having a D-shaped friction contact roller. The media separator includes a separation pad holder that holds a separation pad having a high coefficient of friction. The separation pad operates in a manner similar to that described above, to queue plural sheets of media in the nip and feed the plural sheets through the nip one at a time. The separation pad holder also has a projection having a low coefficient of friction located downstream of the separation pad in the feed direction. A support frame supports the separation pad holder and separation pad for movement, against a bias force, in a direction normal to the media pick roller. A sheet of media fed through the nip of the sheet feeder is subsequently nipped/pulled by a downstream pair of feed rollers at a feeding speed higher than a feeding speed through the nip of the sheet feeder; the sheet of media thereby exerts a tension force on the downstream projection of the separation pad in a direction normal to the media pick roller. The separation pad holder and separation pad use the above noted degree of freedom of movement (normal to the media pick roller), to release the sheet of media from a nip force of the sheet feeder.

Although this media separator mechanism (and method) has utility in many applications, it suffers a general drawback of separation pad mechanisms, in that the separation pad uses a single coefficient of friction region for separating sheets of media in the nip.

Media separator mechanisms using a retard roller provide improved reliability of sheet separation for a variety of types of media having different coefficients of friction. U.S. Pat. No. 5,435,538 discloses a retard sheet feeder including a feed roller and a retard roller having a torque limited slip clutch with an integral reversing bias. The retard roller is free to rotate in the feed direction by use of a spring that is axially aligned with the retard roller and allows the retard roller to slip in the feed direction once a predetermined torque level is reached. When the drive torque to the retard roller is reduced, such as when a double sheet is in the drive nip, the torque is not sufficient to overcome the stored spring energy, and the retard roller rotates in a reverse direction by the spring force to drive the double sheet out of the nip. In this manner, plural sheets of media reliably are fed through the retard sheet feeder one at a time.

Although this mechanism and other mechanisms using a retard roller have utility in many applications, such mechanisms suffer a general drawback of retard roller mechanisms, in that such mechanisms require additional elements, such as slip-clutch mechanisms and the like for passive systems and drive motors, controllers, clutch mechanisms and the like for active systems. These additional elements require a significant increase in space, technical maintenance and cost.

A need exists for an improved media separator and media separator mechanism that readily and reliably separate and feed plural sheets of media one at a time. In particular, a need exists for an improved media separator and media separator mechanism that readily and reliably separate and feed different types of media having different coefficients of friction. Further, a need exists for such an improved media separator and media separation mechanism that are compact, simple in design and low cost.

SUMMARY

An object of the present disclosure is to describe a media separator that efficiently and effectively controls a feeding operation of a sheet of media through a nip, and controls a feeding operation of plural sheets of media through the nip one sheet at a time.

Another object of the present disclosure is to describe a media separator that easily adapts to use with different types of media.

Another object of the present disclosure is to describe a media separator that is compact, simple in design and low cost.

These and other objects and advantages are achieved by a separation pad, media separator and media separator mechanism of the present disclosure, wherein the separation pad includes first and second friction regions, and the media separator supports the separation pad for movement relative to the media separator in a feeding direction through a nip formed by the media separator, against a bias force, to selectively contact the first and second friction regions with a sheet of media fed through the nip with a retard/separation force determined by the bias force.

BRIEF DESCRIPTION OF THE DRAWINGS

FIGS. 1 and 2 are front perspective views of one embodiment of a media separator and separation pad, in which the media separator supports the separation pad for movement between a first position and a second position; FIG. 1 illustrates the media separator and the separation pad arranged in the first position, in which a first friction region of the separation pad is exposed, and a second friction region of the separation pad is shielded by a web extension of the media separator; FIG. 2 illustrates the media separator and the separation pad arranged in the second position, in which the first friction region of the separation pad is exposed, and the second friction region of the separation pad is exposed;

FIG. 7 is a cross-sectional view of a preferred embodiment of a media separator mechanism of the present invention, including a media separator and separation pad of FIGS. 3-6 cooperating with a media pick, in which the separation pad is arranged in the first position; and FIG. 8 is a cross-sectional view of the media separator mechanism of FIG. 7, in which the separation pad is arranged in the second position.

DETAILED DESCRIPTION OF EMBODIMENTS

Figure 3:
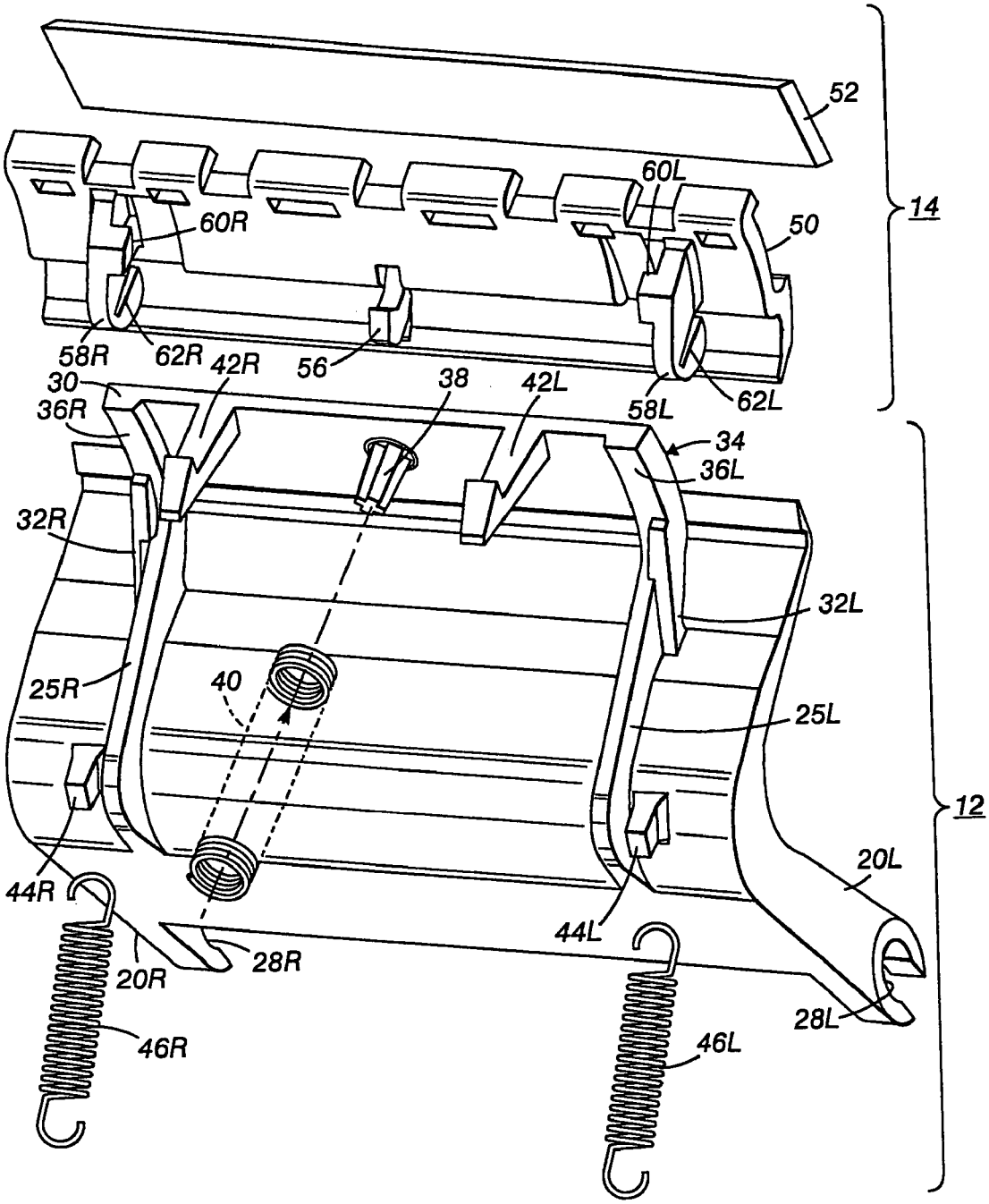
FIG. 3 is an exploded, rear perspective view of a media separator and separation pad, illustrating an embodiment of support structure for the media separator and separation pad.

FIGS. 1-8 illustrate embodiments of a separation pad, media separator and media separator mechanism of the present disclosure. FIGS. 1 and 2 illustrate an embodiment of a separation pad and media separator of the present disclosure. FIGS. 3-6 illustrate an embodiment of a support structure for a separation pad and media separator of the present disclosure. FIGS. 7 and 8 illustrate an embodiment of a media separator mechanism of the present disclosure. The separation pad, media separator and media separator mechanism may be employed in any media handling system, including readers, scanners, printers, copiers, facsimile machines and the like. For example, in one embodiment, the separation pad, media separator and media separator mechanism may be employed in a Xerographic™ printing/copying apparatus.

FIGS. 1 and 2 are front perspective views of an embodiment of a media separator and separation pad of the present disclosure, in which the separation pad is arranged in a first position and a second position, respectively. In its simplest form, a media separator 10 of the present disclosure comprises a bracket 12 and a separation pad 14. The separation pad 14 has a contact surface including a first friction region 16 and a second friction region 18. The first friction region 16 has a coefficient of friction greater than that of the second friction region 18, and the second friction region 18 is located upstream of the first friction region 16 in a feeding direction (see arrow A). In this embodiment, the bracket 12 and separation pad 14 are separate elements that cooperate to perform certain functions, as discussed below. In this manner, the separation pad 14 may be replaced as desired, e.g., for routine maintenance and the like. Alternatively, bracket 12 and separation pad 14 may be formed as a single, unitary piece having a live hinge. Those skilled in the art readily will recognize alternative designs and embodiments of the separation pad and media separator that variously achieve the functions discussed below.

In operation, the separation pad 14 moves relative to the bracket 12 along the feeding direction, against a bias force, to selectively present the first and second friction regions 16, 18. Specifically, the separation pad 14 moves relative to the bracket 12 between the first position, in which the first friction region 16 is presented (exposed) and the second friction region 18 is shielded by the bracket 12 (FIG. 1), and the second position, in which both the first friction region 16 and the second friction region 18 are presented (FIG. 2). As discussed in greater detail below, in this manner the first and second friction regions 16, 18 of separation pad 14 may selectively engage a sheet of media fed through a nip formed by the media separator 10, with a retard/separation force determined by the bias force; this selective engagement reciprocally moves the separation pad 14 relative to the bracket 12 along the feed direction, thereby to control a feeding operation of the sheet of media fed through the nip.

In the embodiments of FIGS. 1-2, 3-6 and 7-8, the bracket 12 is generally L-shaped in cross-section and includes at least one bracket arm 20 (e.g., first/Right and second/Left bracket arms 20R, 20L) a web 22 (e.g., extending between the first and second bracket arms 20R, 20L) and a web extension 24 at a distal end of web 22. The web extension 24 may include reinforcing structure 25 (e.g., longitudinal ribs 25R, 25L extending along the height/length of the web extension 24), and may include a jaw and tongue region 26 formed at the distal end thereof. Each bracket arm 20R, 20L may include a pivot support joint 28 (e.g., C-shaped bearings 28R, 28L) that pivotally supports the bracket 12 for rotation about a common axis. Bracket 12 may be made of any material suitable for handling sheets of media; bracket 12 may be made of plastic, e.g., polycarbonate (PC), polystyrene (PS), acrylonitrile butadiene styrene (ABS), PC/ABS blend, acetal, nylon and the like by an injection molding process. It will be appreciated that this configuration of bracket 12 provides a compact, light-weight structure that can rotatably support separation pad 14 to form a nip with a media pick, with the jaw and tongue region 26 cooperating with the media pick to form a mouth of the nip (see, e.g., FIGS. 7 and 8 discussed below). Those skilled in the art readily will appreciate alternative structures and materials suitable for any particular application.

Figure 4:
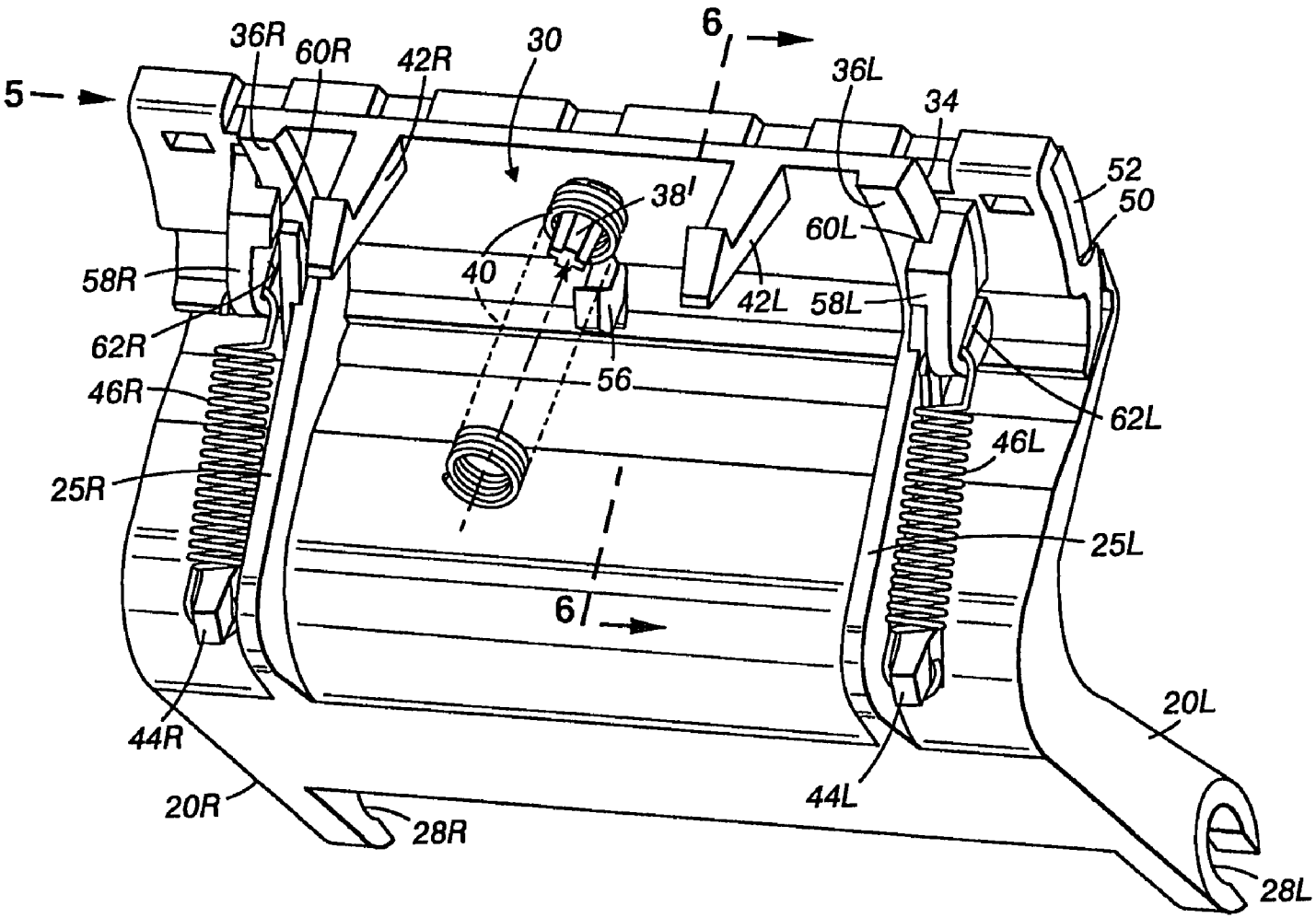
FIG. 4 is a rear perspective view of the media separator and separation pad of FIG. 3, illustrating the support structure of the media separator and separation pad assembled and arranged in the first position.
Figure 5:
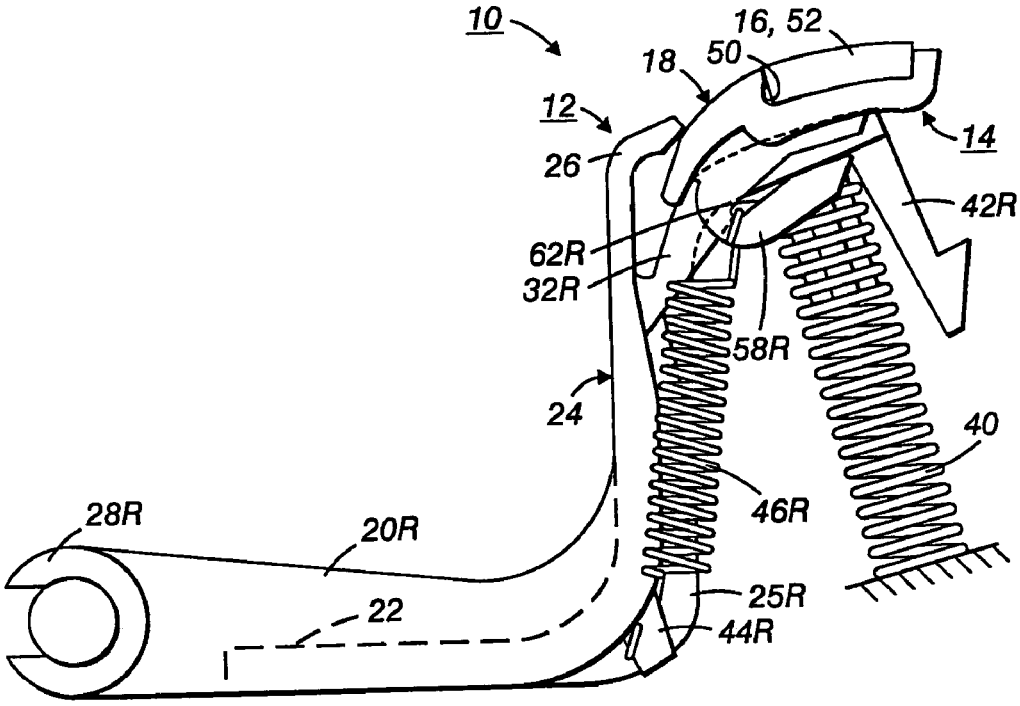
FIG. 5 is an end view of the media separator and separation pad of FIGS. 3 and 4, as viewed from the direction of arrow 5 in FIG. 4, illustrating the support structure arranged in the second position.
Figure 6:
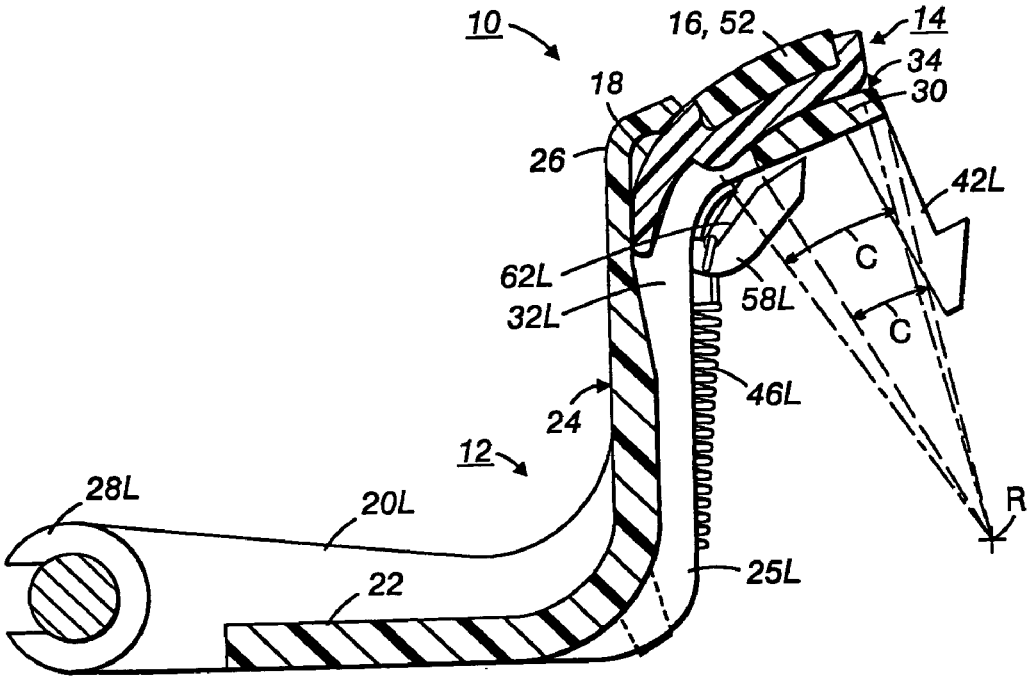
FIG. 6 is a partial cross-sectional view of the media separator and separation pad of FIGS. 3 and 4, taken along section line 6-6 in FIG. 4, illustrating the support structure arranged in the first position.

FIGS. 3-6 illustrate an embodiment of a media separator and separation pad of the present disclosure, including support structure that supports the media separation pad for reciprocal movement between the first and second positions, against a bias force. Specifically, FIGS. 3-6 illustrate a slide mechanism support structure. FIG. 3 is an exploded, rear perspective view of the media separator and separation pad, illustrating an embodiment of the slide mechanism support structure for the media separator and separation pad. FIG. 4 is a rear perspective view of the media separator and separation pad of FIG. 3 assembled and arranged in the first position. FIGS. 5 and 6 are an end view and a partial cross-sectional view, respectively, of the media separator and separation pad of FIGS. 3 and 4.

In the embodiment of FIGS. 3-6, the web extension 24 supports the separator pad 14 for movement relative to the bracket 12. In this embodiment, the slide mechanism support structure includes a guide beam 30 extending transversely across web extension 24 and supporting the separation pad 14 for movement relative to web extension 24 of bracket 12. In one configuration, beam 30, first friction region 16 and second friction region 18 all extend parallel with the jaw and tongue region 26 of the distal end of web extension 24. Beam 30 may be integrally formed with web 22/web extension 24 as a single unitary piece. For example, beam 30 may be provided as a transverse extension of longitudinal ribs 25R, 25L. Alternatively, beam 30 may be separately formed and fixed, e.g., to ribs 25R, 25L, at respective beam feet 32R, 32L by adhesives, connectors or other conventional attachment/fixing means. In the latter construction, beam 30 may be composed of different materials particularly suitable for various slide support functions, as discussed below. Beam 30 may be made from plastic (e.g., PC, PS, ABS, PC/ABS blend, acetal, nylon and the like) or sheetmetal. Those skilled in the art readily will appreciate alternative structures and materials for guide beam 30 in view of the functions discussed below.

Beam 30 includes guide means for supporting separation pad 14 for sliding movement relative to bracket 12. In the present embodiment, beam 30 includes a first guide surface (top side surface) 34 that engages and supports separation pad 14 for sliding movement relative thereto. Beam 30 may also include a second guide surface 36 (e.g., retaining guide surfaces 36R, 36L located on a bottom side of beam 30, at each end thereof) that engages a complementary retaining slide surface of separation pad 14, in opposing/mating fashion, to capture separation pad 14 and retain it in sliding contact with guide surface 34. Those skilled in the art readily will appreciate alternative guide surface means and equivalent support structures.

Bracket 12 may include additional cooperating support structures suitable for the particular application. In the embodiments of FIGS. 3-6 and 7-8, for example, beam 30 includes a first spring receiving projection 38 that receives a compression spring 40, for engaging a media handling system housing to bias the bracket 12 to rotate toward a nip with a nip force (collectively bracket bias means; see FIGS. 7 and 8 below). Beam 30 likewise may include a rotation stop projection 42, such as retaining pawls 42R, 42L located on a bottom side of beam 30, for engaging the media handling system housing to prevent over rotation of the bracket 12 into the nip (collectively bracket retaining means or rotation stop means; see FIGS. 7 and 8 below). Bracket 12 further includes a second spring receiving projection 44 (e.g., spring hook receiving projections 44R, 44L located on web extension 24) for receiving spring bias means 46 (e.g., tension springs 46R, 46L), to bias separator pad 14 toward the first position (collectively separation pad bias means). The second spring receiving projection 44 may include stepped notches (not numbered) for incrementally increasing the spring bias (tension) force of spring bias spring 46 (tension springs 46R, 46L). Those skilled in the art readily will appreciate additional, alternative and/or equivalent support structures suitable for any particular application.

In the embodiments of FIGS. 1-2, 3-6 and 7-8, the separation pad 14 includes first and second friction regions 16, 18 having different coefficients of friction. As shown in FIGS. 1-8, the separation pad 14 may include first and second friction regions 16, 18 made of different materials having different coefficients of friction. Specifically, separation pad 14 may include a channel 50 formed in a top side surface thereof for receiving a friction pad 52 made of a different material having a higher coefficient of friction. Further, the separation pad 14 and friction pad 52 may have different configurations. In one configuration, as shown in FIGS. 5 and 6, the channel 50 and friction pad 52 may have complementary arcuate surfaces/shapes that facilitate capture of the friction pad 52 in the channel 50 and present a smooth arcuate contact surface (16, 18). In an alternative configuration (not shown), the channel 50 and friction pad 52 may have complementary flat surfaces (e.g., friction pad 52 may be rectangular in cross-section) that facilitate low cost manufacturing of the friction pad 52 and separation pad 14. The separation pad 14 may be made of plastic (e.g., PC, PS, ABS, PC/ABS, acetal, nylon and the like); the second friction region 18 of separation pad 14 may have a coefficient of friction in the range of 0.05 to 0.70, or alternatively in the range of 0.05 to 0.2, depending on the media to be used. The friction pad 52 may be made of an elastomer (e.g., EPDM, urethane, latex, polyisoprene and the like), cork products or mixtures encompassing both; the friction pad 52 may have a coefficient of friction in the range of 0.75 to 2.0, or alternatively in the range of 1.0 to 1.5, depending on the media to be used. Alternatively, or in addition, at least one of the first and second friction regions 16, 18 can be formed by surface working the top side surface of separation pad 14. Examples of surface working structures/procedures include longitudinal or lateral/transverse ridges or projections, longitudinal or lateral/transverse grooves or slots, forward or reverse inclined ridges or grooves, dimpled or knobbed surfaces, and the like. Those skilled in the art readily will be able to select different configurations, materials and/or surface working features having different coefficients of friction suitable for any application.

The separation pad also may include complementary support structure suitable to the specific application. In the embodiments of FIGS. 3-6, the separation pad 14 includes, on a bottom side surface thereof, a slide surface 54, a slide stop 56, and retaining slide means 58 (e.g., right and left retaining slide members 58R, 58L). In this embodiment, each retaining slide member 58R, 58L includes a respective guide follower 60 (e.g., right and left slide surfaces 60R, 60L) for engaging guide surfaces 36R, 36L of beam 30, and bias spring receiving means 62 (e.g., slots 62R, 62L) for receiving respective bias springs 46R, 46L.

As best shown in FIG. 4, when assembled the complementary structures cooperate to provide controlled relative movement between the bracket 12 and separation pad 14. Slide surface 54 and the slide surfaces 60R, 60L of retaining slide members 58R, 58L engage the first guide surface 34 and second guide surfaces 36R, 36L, respectively, and thereby capture the guide beam 30 for relative sliding movement therebetween. One hook of each bias spring 46R, 46L is hooked around a respective projection 44R, 44L, and the other hook of each bias spring 46R, 46L is hooked through a respective slot 62R, 62L of retaining slide members 58R, 58L. In this manner, the separation pad 14 is supported on the beam 30 of bracket 12, for sliding movement relative to bracket 12, against a bias force; that is, the separation pad 14 is biased to slide in a direction of the first position by spring tension force of bias springs 46R, 46L. Sliding stop 56 is arranged to engage either the web extension 24 or beam 30 when the separation pad 12 is in the second position, to prevent over rotation of the separation pad 14 through the nip. Bracket bias spring 40 captures projection 38 and is supported thereon to provide a compression force corresponding to the nip force of the media separator.

FIGS. 5 and 6 illustrate additional details and features of the slide mechanism of the media separator and separation pad of the present embodiment. FIG. 5 is an end view of the media separator and separation pad, as viewed from the direction of arrow 5 in FIG. 4, illustrating elements of the slide mechanism and bias means in the second position. FIG. 6 is a partial cross-sectional view of the media separator and separation pad, taken along section line 6-6 in FIG. 4, illustrating elements of the slide mechanism and bias means in the first position.

The slide mechanism of the present embodiment selectively presents the first friction region 16 and the second friction region 18 of the separation pad 14. As shown in FIGS. 4 and 6, when separation pad 14 is located in the first position, the first friction region 16 (friction pad 52) is presented/exposed relative to the jaw and tongue region 26 of web extension 24, and the second friction region 18 is shielded by the jaw and tongue region 26 of web extension 24. As shown in FIG. 5, when the separation pad 14 is located in the second position, both the first friction region 16 (friction pad 52) and the second friction region 18 are presented/exposed relative to the jaw and tongue region 26 of the web extension 24.

As best shown in FIG. 6, guide surface 34 of guide beam 30 and slide surface 54 of separation pad 14 may have complementary surface configurations (shapes) to provide smooth sliding movement therebetween, between the first position and the second position. In the embodiment of FIGS. 3-6, guide surface 34 and slide surface 54 have complementary curved (arcuate) configurations that provide and maintain a substantially consistent point of contact and/or range of contact between the contact surface of the separation pad 14 (including first and second friction regions 16, 18) and a sheet of media passing through a nip formed by the media separator 10. For example, guide surface 34 and slide surface 54 may have an arcuate curve of C (e.g., 40°+/−5°) and radius R (e.g., 9.5+/−0.1 mm). Second guide surface 36 and slide surface 60 likewise may have complementary configurations (e.g., curved configurations) that cooperate with guide surface 34 and slide surface 54 to retain separation pad 14 in smooth sliding contact with guide beam 30. Those skilled in the art readily will be able to select appropriate configurations suitable to any particular application.

FIGS. 7 and 8 illustrate an embodiment of a media separator mechanism of the present disclosure. As shown therein, the media separator mechanism generally comprises a separation pad 14 and media separator 10 of FIGS. 3-6 cooperating with a media pick (e.g., a conventional D-shaped pick roller) 64 to form a nip therebetween. FIG. 7 is a cross-sectional view of a media separator mechanism in which the separation pad is in the first position; and FIG. 8 is a cross-sectional view of the media separation mechanism, in which the separation pad is in the second position.

FIGS. 7 and 8 generally illustrate movements of a sheet of media, the separation pad, and the media separator during a pick cycle. As shown in FIGS. 7 and 8, the media pick 64 rotates, picks up a sheet of media S from a media stack MS on a tray 66 and feeds the sheet of media through the nip to a feed path 68 of a media handling system, such as a Xerographic™ printing/copying apparatus. The media separator 10 is supported at pivot support joints 28R, 28L for pivotal movement about a common axis/axle of the system housing H. Bias spring 40 of bracket 12 engages a portion of the system housing H (not numbered; shown in cross-section) to rotate separation pad 14 into the nip with media pick 64 with a nip force $F_{nip}$. A retaining pawl 42 is shown arranged opposite a stop surface of the media processing system housing H (not numbered; shown in cross-section) to prevent over rotation of the media separator 10 and separation pad 14 into the nip when the media pick is removed, such as for jam access.

As shown in FIGS. 7 and 8, during each pick cycle media pick 64 frictionally engages and pulls/drives a sheet of media S into and through a nip formed between the media pick 64 and the media separator 10. Each sheet of media S fed through the nip engages the jaw and tongue region 26 of the web extension 24 and is guided into the nip to engage the first (high) friction region 16, 52 of the separation pad 14 (FIG. 7). The sheet of media S engages the high friction region 16, 52 of the separation pad 14 with a frictional force sufficient to drive the separation pad 14 to slide relative to the beam 30 of the bracket 12 in a feeding direction A of the sheet of media S. The sheet of media S thus acts against the bias force (spring bias force) of bias springs 46R, 46L and slides the separation pad 14 to the second position (FIG. 8). In this manner, the separation pad 14 exerts a retard/separation force against the sheet of media equal to the bias force of the bias springs 46R, 46L throughout the pick cycle.

Design criteria for the dual friction separation pad and media separator of the present invention are similar to that of a retard roller. The retard/separation force $F_{ret/sep}$ between a sheet of media fed through the nip and in contact with the separator pad is the lesser of $$F_{ret/sep}=F_{springbias} \tag{7}$$

or $$F_{ret/sep}=F_{nip}\times\mu_{pad\text{-}media} \tag{8}$$

where $F_{springbias}$ is the spring bias force of the spring bias means 46 (tension springs 46R, 46L), and $\mu_{pad\text{-}media}$ is the coefficient of friction between the high friction region 16 and the sheet of media. As in the case with a retard roller, the designer in this case may choose a coefficient of friction of the first frictional region of the separation pad $\mu_{pad\text{-}media}$ sufficiently high that the first equation applies. In this manner, $F_{ret/sep}$ is independent of $F_{nip}$ and the designer may independently adjust the driving and separation forces for maximum performance.

To operate properly, the bias force (retard spring force) is set less than the potential friction force between the first (high) friction region and a sheet of media $\mu_{hfr\text{-}media}$, and greater than the potential friction force between the second (low) friction region and the sheet of media $\mu_{lfr\text{-}media}$, as follows:

$$F_{nip}\times\mu_{hfr\text{-}media}>F_{springbias}>F_{nip}\times\mu_{lfr\text{-}media} \tag{9}$$

In this manner, the separation pad will self-adjust so that a picked sheet slides partially on the first (high) friction region and partially on the second (low) friction region, and the separation pad always will exert a retard/separation force on the sheet of media equal to the bias force of the retard spring during a pick cycle. The bias force (retard spring force) is set sufficiently high to separate multiple sheets of media simultaneously fed into the nip, but low enough to allow a single sheet of media to pass through the nip under the drive force of the media pick. In one embodiment the nip force $F_{nip}$ may be in the range of 2.0 to 3.0 Newtons and the separation/retard force $F_{ret/sep}$ may be in the range of 2.0 to 3.0 Newtons. Those skilled in the art will be able to identify other nip and retard forces suitable in a particular application.

Operation of the media separator mechanism is described in more detail with reference to several examples below.

In a first case, a single sheet of media S is fed into the nip by media pick 64 with a driving force $F_{drive}$ equal to the friction force $F_{pick\text{-}sheet}$ between the media pick 64 and the sheet of media S. The sheet of media S initially will contact the first (high) friction region 16 of the separator pad 14 with a friction force $F_{pad\text{-}sheet}$ sufficient to overcome the retard/separation force $F_{ret/sep}$ (equal to the bias force of springs 46R, 46L) and cause the separation pad 14 to slide in the feed direction A. The sheet of media S fed through the nip by the media pick 64 will continue to drive the separation pad 14 forward until the bottom surface of the sheet of media S bridges the first (high) friction region 16 and the second (low) friction region 18 of the separation pad 14. The sheet of media S then will continue to slide over a combination of the first (high) friction region 16 and the second (low) friction region 18 as it advances through the nip. The first (high) friction region 16 of the separation pad 14 will continue to exert a retard/separation force $F_{ret/sep}$ (equal to the bias force of springs 46R, 46L) on the sheet of media S until the trailing end of the sheet of media S passes through the nip. When the trailing edge of the sheet of media S leaves the nip, and there is no longer a frictional force $F_{pad\text{-}sheet}$ driving the separation pad 14 in the feeding direction A, the separation pad 14 will slide back to the first position, ready for a new pick cycle.

In a second case, two sheets of media are fed into the nip by the media pick 64. The bottom surface of the bottom sheet of media $S_{bot}$ initially will contact the first (high) friction region 16 of the separation pad 14. However, the driving force $F_{dbot}$ for the bottom sheet of media $S_{bot}$ is the friction force $F_{sheet\text{-}sheet}$ between the sheets of media. This friction force $F_{sheet\text{-}sheet}$ is insufficient to overcome the retard/separation force $F_{ret/sep}$ (equal to the bias force of springs 46R, 46L), so the bottom sheet of media $S_{bot}$ will stop at the first (high) friction region 16. The top sheet of media Stop in contact with the media pick 64 is driven through the nip with a drive force $F_{dtop}$ equal to the friction force $F_{pick\text{-}sheet}$ between the media pick 64 and the top sheet of media $S_{top}$. The top sheet of media $S_{top}$ therefore will continue to pass through the nip and contact the first (high) friction region 16 of the separation pad 14 with a friction force $F_{pad\text{-}sheet}$ sufficient to overcome the retard/separation force $F_{ret/sep}$; the top sheet of media $S_{top}$ then will drive the separation pad 14 in the feed direction toward the second position, where the bottom surface of the top sheet of media Stop bridges the first (high) friction region 16 and the bottom sheet of media $S_{bot}$. The top sheet of media $S_{top}$ then will slide over a combination of the first (high) friction region 16 and the bottom sheet of media $S_{bot}$ as it advances through the nip. The first (high) friction region 16 of the separation pad 14 will continue to exert a retard/separation force $F_{ret/sep}$ (equal to the bias force of springs 46R, 46L) on the top sheet of media $S_{top}$ until the trailing end of the top sheet of media $S_{top}$ passes through the nip. When the trailing edge of the top sheet of media $S_{top}$ leaves the nip, and there is no longer a frictional force $F_{pad\text{-}sheet}$ driving the separation pad 14 in the feed direction A, the separation pad 14 will slide back to the first position and, within the limits of its travel, push the bottom sheet of media $S_{bot}$ out of the nip, ready for a new pick cycle.

In a case where more than two sheets of media are fed into the nip by the frictional driving force, operation is substantially similar to the case of two sheets. Media pick 64 by frictional force pulls the top sheet of media into the mouth of the nip; the top sheet of media engages the jaw and tongue region 26 of web extension 24 and is guided into the nip, where the top sheet of media engages the first (high) friction region 16 of the separator pad 14 with a frictional force that retards movement of the top sheet of media through the nip. The top sheet of media by frictional force $F_{sheet\text{-}sheet}$ in turn pulls the next adjacent sheet of media (second sheet) into the mouth of the nip; the second sheet of media engages the jaw and tongue region 26 and is guided into the nip, where the second sheet of media engages the first (high) friction region 16 of the separator pad 14 with a frictional force that retards movement of the second sheet through the nip. Each sheet of media pulled by the sheet to sheet friction force exerts a similar frictional force and pull on a successive sheet of media in the media stack. In this manner, the media pick 64 pulls plural sheets of media into the mouth of the nip, and into frictional engagement with the first (high) friction region 16 of the separator pad 14. The driving force of the top sheet of media in contact with the media pick is sufficient to drive the top sheet of media through the nip against the retard/separation force of the separation pad 14. However, the retard/separation force of the first (high) friction region 16 of separation pad 14 is sufficient to retard a feeding operation of each of the sheets of media other than the sheet of media in contact with the media pick 64. When the trailing edge of the top sheet of media leaves the nip, and there is no longer a frictional force $F_{pick\text{-}sheet}$ driving the separation pad in the feed direction A, the separation pad will slide back to the first position and, within the limits of its travel, push each of the remaining plural sheets of media out of the nip, ready for a new pick cycle.

In the above embodiments, the separation pad has been described having two friction regions. The separation pad may have three or more friction regions, where each of the plural friction regions performs similar or different functions, provided the separation pad includes at least first and second friction regions arranged as disclosed above to provide a retard/separation force determined by the bias force for controlling a feeding operation of a sheet of media fed through a nip. Those skilled in the art will appreciate alternative structures and embodiments suitable to any particular application.

It will be appreciated that the separation pad, media separator and media separator mechanism of the present disclosure thus variously achieve the objects of the present disclosure, and provide advantages over conventional media separators and media separator mechanisms. In the separation pad, media separator and media separator mechanism of the present disclosure, the retard/separation force readily can be tuned, e.g., by changing the force and rate of the retard spring (bias force). The separation pad and media separator of the present disclosure may be made more robust than conventional media separators, thereby extending their life cycle, because the separation force is less dependent on the friction coefficient of the separator pad. The design of the separation pad and media separator of the present disclosure is more compact and has fewer parts than a conventional retard roller, and obtains similar separation reliability. The separation pad and media separator of the present disclosure may be retrofitted into apparatus and systems using a conventional separator pad. The cost of the separator pad/media separator of the present disclosure is similar to that of a conventional separator pad, and the performance is similar to that of a retard roller.

Although the present disclosure has been described with reference to specific embodiments, it is not limited thereto. It will be appreciated that various of the above-disclosed and other features and functions, or alternatives thereof, may be desirably combined into many other systems or applications. Also, various presently unforeseen or unanticipated alternatives, modifications, variations or improvements therein may be subsequently made by those skilled in the art, and are intended to be encompassed by the following claims.

What is claimed is:

1. A media separator that cooperates with a media pick to form a nip in a feed path and to feed sheets of media through the nip, one at a time in a feed direction, the media separator comprising:

a separation pad having a contact surface that forms at least a portion of the nip and a slide surface, the contact surface including a first friction region having a first coefficient of friction, and a second friction region arranged upstream of the first friction region in the feed direction and having a second coefficient of friction less than the first coefficient of friction;

a bracket that supports the separation pad in the nip for movement along the feed direction relative to the bracket between a first position, in which a sheet of media fed through the nip frictionally engages the first friction region and moves the separation pad in the feed direction relative to the bracket by a friction force with the separation pad, against a bias force, and a second position, in which the sheet of media fed though the nip contacts the first friction region and the second friction region and the separation pad frictionally engages the sheet of media fed through the nip with a retard/separation force equal to the bias force, the bracket including a guide surface that engages the slide surface of the separation pad and supports the separation pad for sliding movement along the feed direction relative to the bracket between the first position and the second position; and a retard spring connected between the bracket and the separation pad, and wherein in the first position the sheet of media fed through the nip in the feed direction engages the first friction region with a friction force sufficient to cause the separation pad to move from the first position to the second position against the bias force of the retard spring, and in the second position the separation pad frictionally engages the sheet of media with a retard/separation force equal to the bias force of the retard spring.

2. The media separator according to claim 1, wherein the first friction region is made of a first material and the second friction region is made of a second material different from the first material.

3. The media separator according to claim 2, wherein the first material is selected from the group consisting of elastomers, cork and combinations thereof, and the second material is selected from the group consisting of engineering plastics and sheetmetals.

4. The media separator according to claim 1, wherein the separation pad includes a main body and a friction pad member, wherein the friction pad member is made of a first material and the main body is made of a second material, wherein the main body forms the second friction region and supports the friction pad member, and wherein the friction pad member forms the first friction region.

5. The media separator according to claim 1, further comprising means for adjusting the bias force.

6. The media separator according to claim 1, wherein the bracket comprises:

a least one bracket arm pivotally supporting an end of the bracket about an axis; and a web supported by the at least one bracket arm, and having a web extension supporting the separator pad in the nip.

7. The media separator according to claim 6, wherein the bracket comprises a first bracket arm and a second bracket arm, and the web extends between the first and second bracket arms.

8. The media separator according to claim 6, wherein the bracket further comprises:

a bias member that biases the bracket to pivot about the axis to support the separator pad in the nip with a nip force.

9. The media separator according to claim 8, wherein the bias member is a compression spring.

10. The media separator according to claim 8, wherein the bracket further comprises a rotation stop that prevents the bracket from over-rotating into the nip due to the nip force of the bias member.

11. The media separator according to claim 1, wherein the bracket further comprises a slide stop that prevents the separation pad from sliding past the second position.

12. A media separator mechanism comprising:

a media pick that frictionally drives a sheet of media in a feed direction; and a media separator that forms a nip with the media pick, the media separator comprising:

a separation pad having a contact surface that forms at least a portion of the nip and a slide surface, the contact surface of the separation pad including a first friction region having a first coefficient of friction, and a second friction region arranged upstream of the first friction region in the feed direction of the sheet of media and having a second coefficient of friction less than the first coefficient of friction;

a bracket that supports the separation pad in the nip for movement along the feed direction relative to the bracket between a first position, in which the sheet of media fed through the nip frictionally engages the first friction region and moves the separation pad in the feed direction relative to the bracket by a friction force with the separation pad, against a bias force, and a second position, in which the sheet of media fed through the nip contacts the first friction region and the second friction region and the separation pad frictionally engages the sheet of media fed through the nip with a retard/separation force equal to the bias force, the bracket including a guide surface that engages the slide surface of the separation pad and supports the separation pad for sliding movement along the feed direction relative to the bracket between the first position and the second position; and a retard spring connected between the bracket and the separation pad, and wherein in the first position the sheet of media fed through the nip in the feed direction engages the first friction region with a friction force sufficient to cause the separation pad to move from the first position to the second position against the bias force of the retard spring, and in the second position the separation pad frictionally engages the sheet of media with a retard/separation force equal to the bias force of the retard spring.

13. The media separator mechanism of claim 12, wherein the following relationships are satisfied:

$$F_{drive}<F_{ret/sep}<F_{sheet\text{-}sheet}$$

$$F_{nip}\times\mu_{hfr\text{-}media}<F_{springbias}<F_{nip}\times\mu_{lfr\text{-}media}$$

$$F_{ret/sep}=F_{springbias}$$

where $F_{drive}$ is a frictional drive force of the media pick on a sheet of media fed through the nip by the media pick, $F_{ret/sep}$ is a frictional force of the media separation pad on the sheet of media fed through the nip, $F_{sheet\text{-}sheet}$ is a frictional force between adjacent sheets of media fed through the nip by the media pick, $F_{nip}$ is a nip force between the media separation pad and the media pick, $\mu_{hfr\text{-}media}$ is a coefficient of friction between the first friction region of the separation pad and the sheet of media fed through the nip, $\mu_{lfr\text{-}media}$ is a coefficient of friction between the second friction region of the separation pad and the sheet of media fed through the nip, and $F_{springbias}$ is the bias force on the separation pad moving along the feed direction of the sheet of media between the first position and the second position.

14. The media separator mechanism of claim 12, wherein the media separator mechanism feeds a sheet of media from an external feed tray to a media processing station, the feed tray supporting a media stack including one or a plurality of sheets of media, wherein the media pick picks up and feeds the one or a plurality of sheets of media from the media stack supported on the feed tray to the media processing station;

wherein the media separator forms a nip with the media pick adjacent a feeding edge of the media stack; and wherein the media separator cooperates with the media pick to sequentially feed the one or plurality of sheets of media in the media stack, one at a time, from the feed tray, through the nip, to the media processing station.

15. The media separator mechanism of claim 14, wherein the media separator mechanism is employed in a feed path of a xerographic apparatus, and the media processing station performs xerographic processing.

* * * * *